United States Patent [19]

Seaborn et al.

[11] 4,165,767

[45] Aug. 28, 1979

[54] WIRE FORMING MACHINE

[75] Inventors: Paul Seaborn, Los Gatos, Calif.; Jörn-Uwe Lemburg, Hamburg, Fed. Rep. of Germany

[73] Assignee: E. C. H. Will (GmbH & Co.), Hamburg, Fed. Rep. of Germany

[21] Appl. No.: 906,607

[22] Filed: May 16, 1978

[51] Int. Cl.[2] ..... B21F 1/04

[52] U.S. Cl. ..... 140/105; 72/191

[58] Field of Search ..... 140/71 R, 105; 72/190, 72/191

[56] References Cited

U.S. PATENT DOCUMENTS

| | | | |
|---|---|---|---|
| 2,047,717 | 7/1936 | VanDresser et al. | 140/105 |
| 2,097,193 | 10/1937 | Jacobs | 140/105 |
| 2,169,420 | 8/1939 | Jacobs | 140/105 |
| 4,047,544 | 9/1977 | Seaborn | 140/105 |

*Primary Examiner*—Lowell A. Larson
*Attorney, Agent, or Firm*—Peter K. Kontler

[57] ABSTRACT

A machine which converts a strand of wire into a body of meandering shape has two carriers which rotate about parallel axes and respectively carry annuli of pins. One annulus of pins surrounds the other annulus of pins, and each pin of one annulus is adjacent to a pin of the other annulus. When the carriers rotate, neighboring pins of the two annuli move toward each other during one-half of each orbital movement about the respective axes and away from each other during the other half of each orbital movement. A looping device winds the wire alternately about the oncoming pins of the inner and outer annuli while the neighboring pins move away from each other whereby the wire is converted into a meandering body and the wire portions between successive pins are stretched to assume a predetermined shape. The meandering body is stripped off the pins while the neighboring pins move nearer to each other. The meandering body can be used as a starting material for binders which connect the sheets of note books, calendars or the like.

13 Claims, 8 Drawing Figures

WIRE FORMING MACHINE

BACKGROUND OF THE INVENTION

The present invention relates to wire forming machines in general, and more particularly to improvements in machines for converting a strand of wire into a product of undulate or meandering shape. Still more particularly, the invention relates to improvements in machines which can impart to a continuous strand of wire a configuration which enables the deformed strand to be readily converted into discrete binders of note books, calendars or analogous stationery products. Reference may be had to U.S. Pat. No. 4,020,516 granted May 3, 1977 to Gomez. FIG. 1 of the patent shows a continuous strand of undulate wire, and FIG. 2 shows the binder which is obtained by imparting to the prongs of the undulate wire a circular shape.

Certain presently known wire forming machines employ two wheels which rotate about mutually inclined axes and carry pins which move away from each other during one half and toward each other during the other half of each revolution of the wheels. A rotary looping arm alternately winds the wire around successive pins of the two wheels while the pins move away from each other. The looped wire is tensioned so that each of its sections assumes a predetermined shape during travel toward the location of maximum distance between the pins. The stress upon the loops is thereupon relaxed so that the undulate product can be readily lifted off the pins and transported to storage or directly to a further processing machine.

A drawback of such deforming machines (disclosed, for example, in U.S. Pat. No. 3,691,808 granted Sept. 19, 1972 to Calvert et al.) is that the mounting of wheels for rotation about mutually inclined axes presents serious problems. Furthermore, the rotary looping arm must perform a complex movement in order to bypass the pins which approach the looping station as well as those pins which advance beyond the looping station. Still further, the patented machine is rather bulky and certain parts thereof are not readily accessible for inspection and/or replacement. In addition, the conversion from making undulated wire with prongs of a first length to the making of undulate wire with longer or shorter prongs is a time-consuming operation which takes several hours.

OBJECTS AND SUMMARY OF THE INVENTION

An object of the invention is to provide a simple, compact and rugged wire forming machine wherein the conversion from the making of one type or size of undulated product to the making of another type or size of such product takes up a minute fraction of the time which such operation requires in conventional machines.

Another object of the invention is to provide a wire forming machine wherein all important components which require frequent inspection or replacement are readily observable and accessible.

A further object of the invention is to provide a machine wherein successive increments or sections of looped wire can be adequately tensioned and shaped without resorting to parts which rotate about mutually inclined axes.

An additional object of the invention is to provide the machine with novel and improved means for controlling the movements of wire bending elements so that such elements do not interfere with movements of other parts even though they are invariably placed in an optimum position for engagement with the wire at the looping station.

A further object of the invention is to provide the machine with novel and improved means for controlling the tensional stress upon those increments of the wire which approach the looping station.

An ancillary object of the invention is to provide the machine with novel and improved mobile carriers for the wire looping elements.

The invention is embodied in a wire forming machine which comprises first and second carriers rotatable about parallel axes (e.g., about closely adjacent horizontal axes), means for rotating the carriers in a predetermined direction (such rotating means may include a first unit which transmits torque to one of the carriers and a second unit which transmits torque from the one carrier to the other carrier), and first and second annuli of projections which are respectively provided on and are concentric with the first and second carriers. Each projection of one annulus is adjacent to a projection of the other annulus, and one of the annuli surrounds the other annulus so that, when the carriers rotate, the distance between the neighboring (adjacent) projections of the two annuli increases during movement from first to second portions of the paths of orbital movement of the projections and thereupon decreases during movement from the second to the first portions of such paths. The machine further comprises means for alternately looping a strand of wire seriatim about successive projections of the first and second annuli during movement of projections from the first toward the second portions of the respective paths whereby the wire is converted into a product or body of meandering or undulate shape and is automatically stretched during further movement toward the second portions of the respective paths. Still further, the machine comprises means for separating the meandering product from the projections during movement of projections from the second toward the first portions of the respective paths.

The width of projections of one of the annuli, as considered in the direction of movement of projections along the respective paths, may exceed the width of projections of the other annulus.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
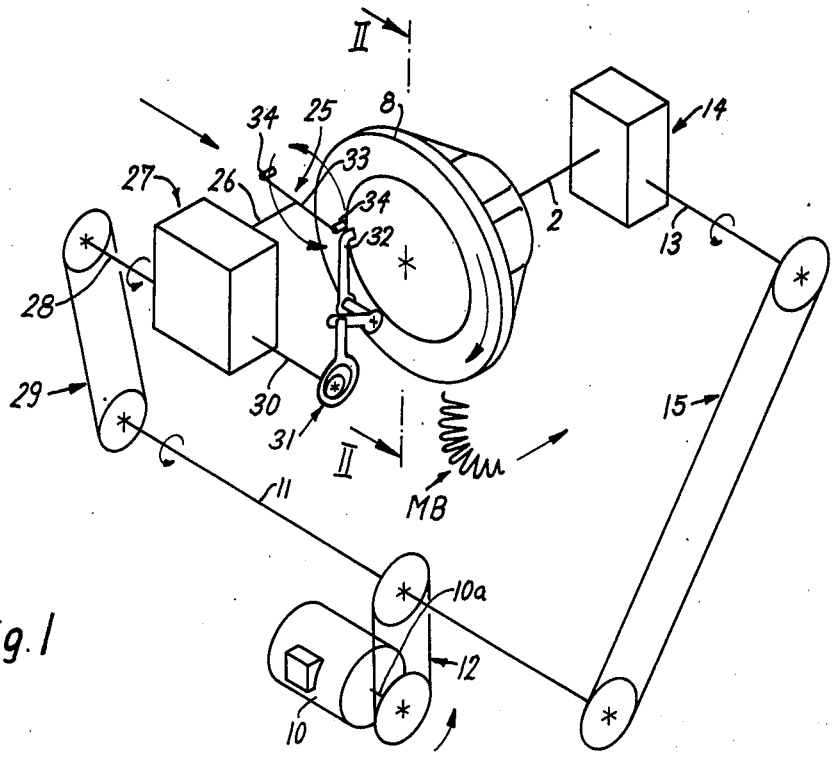
FIG. 1 is a schematic perspective view of a wire forming machine which embodies one form of the invention.
Figure 2:
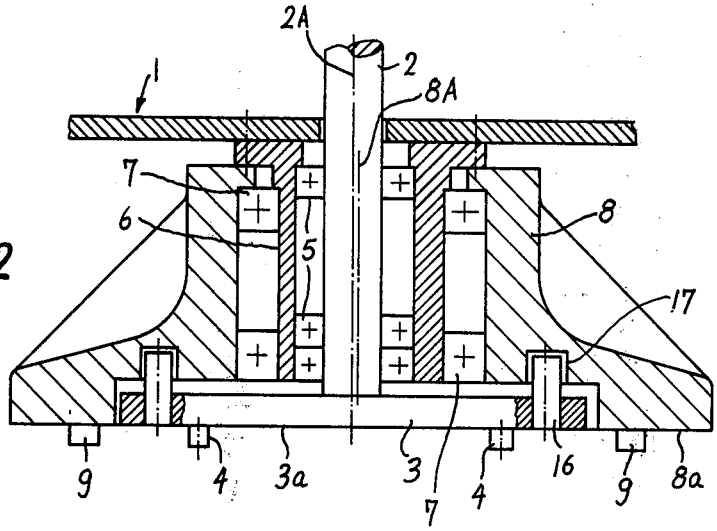
FIG. 2 is an enlarged sectional view as seen in the direction of arrows from the line II—II of FIG. 1.

Referring first to FIGS. 1 and 2, there is shown a wire forming machine which comprises a frame or housing 1 supporting a horizontal shaft 2 for a disk-shaped carrier 3 having a front face 3*a* provided with a concentric annulus of cylindrical pin-shaped wire deforming elements or projections 4. The shaft 2 is mounted in antifriction bearings 5 which are installed in a bearing sleeve 6 whose flange is bolted or otherwise fixedly secured to the frame 1. The thickness of the sleeve 6, as considered in the circumferential direction of the shaft 2, varies between a maximum and a minimum value, and this sleeve is surrounded by antifriction bearings 7 for a ring-shaped carrier 8 having a concentric annulus of wire deforming elements or projections 9 in the form of slender dogs extending radially of the carrier 8. The axes of rotation of the shaft 2 (carrier 3) and carrier 8 are respectively shown at 2A and 8A; the distance (e.g., 40 thousandths of an inch) between these axes equals the eccentricity of the annulus of projections 9 with respect to the annulus of projections 4. It will be noted that the annulus of projections 9 surrounds the annulus of projections 4.

The means for rotating the carriers 3 and 8 in a predetermined direction (clockwise, as viewed in FIG. 1) comprises a first unit which transmits torque to the shaft 2 and hence to the inner carrier 3, and a second unit which transmits torque from the inner carrier 3 to the outer carrier 8. The first torque transmitting unit comprises a prime mover 10 (e.g., a D.C. motor) which is mounted in or on the frame 1 and whose output element 10*a* drives an intermediate shaft 11 by way of a toothed belt or chail transmission 12. The shaft 11 rotates the input element 13 of a variable-speed transmission 14 by way of a further toothed belt or chain drive 15, and the output element of the transmission 14 is coupled to or constitutes the shaft 2 for the carrier 3.

The second torque transmitting unit comprises several pins 16 which are rigid with the carrier 3 and extend into radial slots 17 of the carrier 8. The pins 16 are movable radially of the carrier 8 (or vice versa) but are preferably received in the respective slots 17 without any or with negligible clearance, as considered in the circumferential direction of the sleeve 6. The number of pins 16 and corresponding slots 17 preferably exceeds four, and the pins and slots are equally spaced apart from each other, as considered in the circumferential direction of the respective carriers.

The projections 4 are angularly offset with respect to the projections 9, as considered in the direction of orbital movement of projections about the respective axes 2A, 8A.

Figure 3:
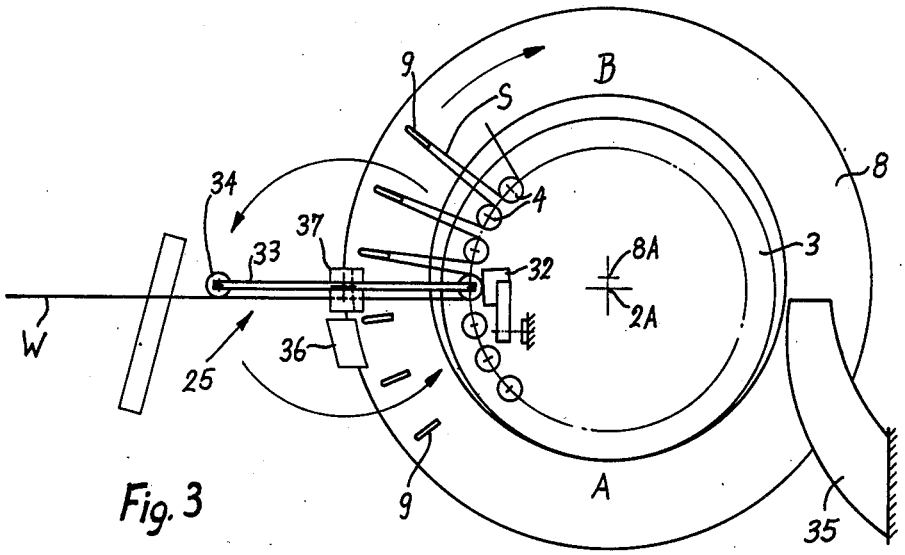
FIG. 3 is a schematic front elevational view of the forming station, showing that stage of operation when the wire is looped around a deforming element or projection of the inner annulus of projections.

When the motor 10 drives the shaft 2, the carriers 3 and 8 rotate clockwise, as viewed in FIG. 3, whereby the annuli of projections 4 and 9 respectively orbit about the axes 2A and 8A and move along circular paths having first portions which are nearest to each other (at a location A) and second portions which are remotest from each other (at a location B). Each projection 9 is adjacent to or associated with a projection 4, and the projections 4, 9 of each such pair of neighboring projections move nearer to each other during movement from the location B toward the location A. Such projections move apart during movement from the location A toward the location B.

Figure 8:
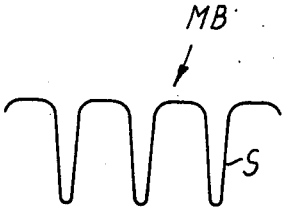
FIG. 8 shows a length of the product which is produced by the machine of FIG. 1.
Figure 4:
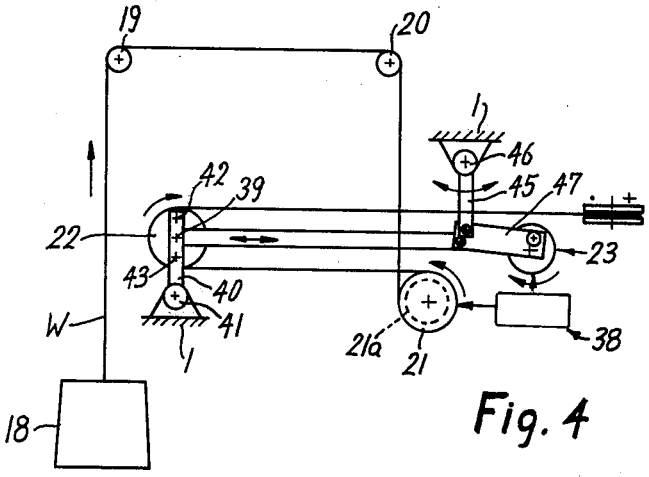
FIG. 4 shows the wire feeding means of the machine.

The wire W is stored in a barrel 18 (FIG. 4) and passes over guide rolls 19, 20 on to a braking wheel 21 and thence over a reciprocating roll 22 which receives motion from a crank unit 23 and intermittently pulls the wire W from the barrel 18. The roll 22 is rotated by the wire W which thereupon passes through a straightening unit 24 (see FIG. 5) and on to a looping device 25 which loops the wire alternately about successive projections 4 and 9 to thus convert the wire into a meandering comb-like product MB shown in FIGS. 1 and 8.

The looping device 25 comprises a shaft 26 which is parallel with the shaft 2 and is coupled to or constitutes the output element of a variable-speed transmission 27. The input element 28 of the transmission 27 is rotated by the intermediate shaft 11 by way of a toothed belt or chain drive 29. A second output element 30 of the transmission 27 drives an eccentric 31 for a pivotable stripping finger 32 which transfers wire W from the looping device 25 onto successive projections 4.

The looping device 25 further comprises a support 33 which extends diametrically of the output element 26 and whose end portions carry orbiting roller-shaped looping elements 34.

The barrel 18 can be replaced with a real or another suitably source of supply of a continuous strand of wire.

Figure 5:
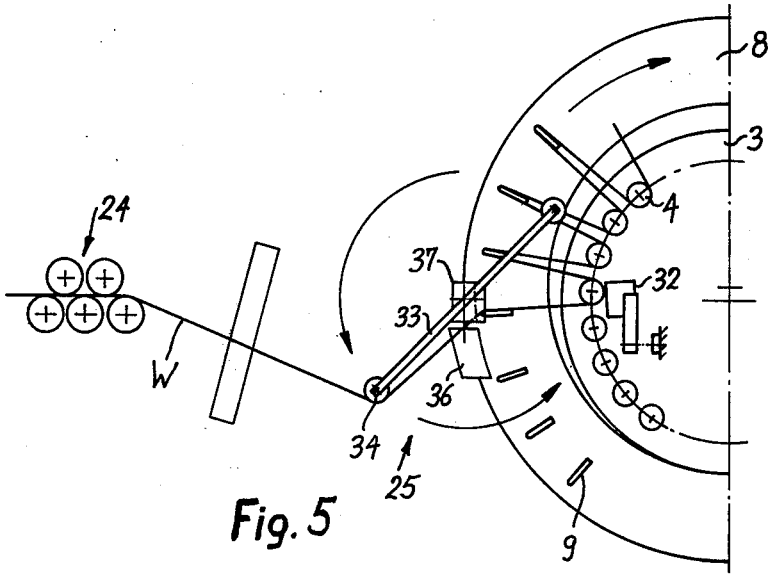
FIG. 5 shows the structure of FIG. 3 during that stage of operation when the wire is looped around a projection of the outer annulus of projections.

The operation is as follows:

The looping device 25 draws wire W from the barrel 18 whereby successive increments of the wire travel around the braking wheel 21 and reciprocating roll 22 and through the straightening unit 24. Starting from the position of FIG. 3 in which one roller 34 of the looping device 25 has moved the wire W into register with the foremost unoccupied projection 4 and in which the stripping finger 32 has completed the transfer of wire onto such projection 4, the support 33 continues to rotate counterclockwise, as viewed in FIG. 3, and advances toward the position which is shown in FIG. 5. At such time, the other roller 34 of the looping device 25 loops the wire W around the oncoming projection 9 and thereupon moves toward and beyond the positions of FIGS. 6 and 7 toward the position occupied by the one roller 34 in FIG. 3. The movements of the looping device 25 are synchronized with movements of the carriers 3 and 8 so that the device 25 turns through 180 degrees while the projections 4 and 9 move through a distance equal to the spacing between the centers of two neighboring projections 4 or 9. As the projections 4 and 9 which are contacted by the looped wire W advance toward the location B (FIG. 3), the distance between the projections 4 and 9 increases whereby the wire sections S between the inner and outer projections undergo a pronounced tensional stress and remain straight after separation from the projections by a stationary disengaging cam 35 which is shown in FIG. 3. The cam 35 removes successive portions of the meandering product MB at or close to the three o'clock position, as viewed in FIG. 3, i.e., substantially diametrically opposite the looping device 25.

The transmission 27 drives the looping device 25 at a varying speed so that the velocity curve of the rollers 34 resembles a sine wave. The right-hand roller 34 of FIG. 3 registers with the oncoming projection 4 at the same time when the left-hand roller 34 engages the wire W prior to looping the wire around the foremost unengaged projection 9.

The reference character 36 denotes a ramp which insures that the looping device 25 can move the wire W in front of oncoming empty projections 9 during movement of a roller 34 toward a position (shown in FIG. 3) of register with the oncoming empty projection 4. The purpose of the ramp 36 will be understood by referring to FIG. 7. A hold-down device 37 is provided at the looping station to prevent the wire from slipping off the freshly engaged projection 9 while a roller 34 moves the next-following portion of the wire toward the oncoming projection 4.

Referring again to FIG. 2, the crank unit 23 is coupled to the braking wheel 21 by a transmission 38 (e.g., a set of gears) which establishes a certain ratio between their angular movements, namely, a ratio which is proportional to the rate of consumption of the wire W. The operation of the crank unit 23 is synchronized with that of the looping device 25 to insure practically continuous withdrawal of wire W from the barrel 18. The rotational speed of the braking wheel 21 is adjusted in response to changes in the consumption of wire W. Such changes take place when the projections 4 are moved radially inwardly of the projections 9 and/or vice versa, i.e., when the length of sections S of the meandering product MB is changed.

The extent of reciprocating movement of the roller 22 can be changed by connecting the shaft 39 of this roller to different portions of a lever 40 which is fulcrumed in the frame 1, and at 41, and has several holes for the shaft 39. Two holes (in addition to that hole which receives the shaft 39) are shown at 42 and 43.

The reciprocating movements of the bar 44 which connects the crank unit 23 with the shaft 39 are stabilized by a lever 45 which is connected to the frame 1 by a pivot 46 and is articulately connected to the crank arm 47 of the unit 23.

The braking wheel 21 is preferably associated with a torque limiter **21*a* (e.g., a torque limiter sold by Dalton and listed under catalog No. OSD-256). Intermittent rotation of the brake wheel 21 is desirable and advantageous because this reduces the amount of heat which is generated by the wheel 21. As can be readily ascertained by looking at FIGS. 3, 5, 6 and 7, the looping device 25 pulls the wire W at a varying speed which alternates between a relatively high speed and zero speed. If the size of the wire W is changed, the braking unit 21, 21*a*** is replaced with a different braking unit.

Figure 6:
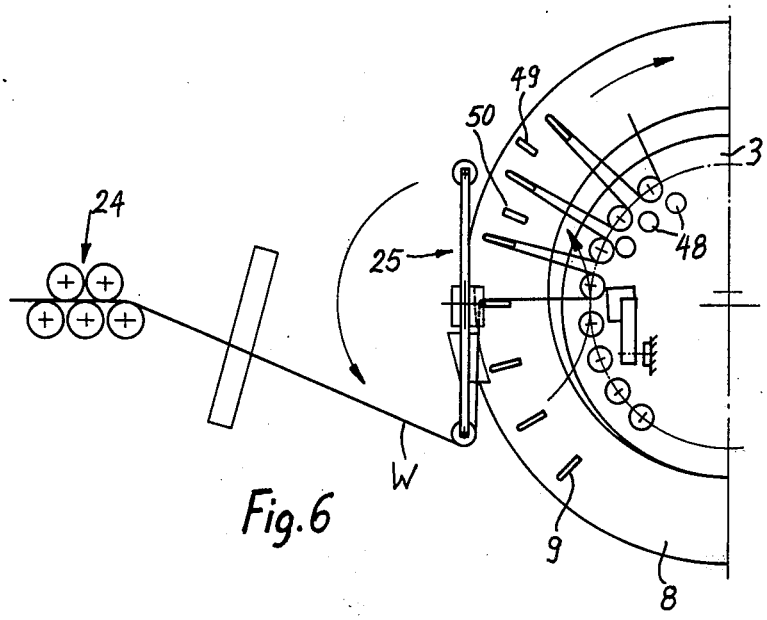
FIGS. 6 and 7 show two additional stages of the wire looping operation.
Figure 7:
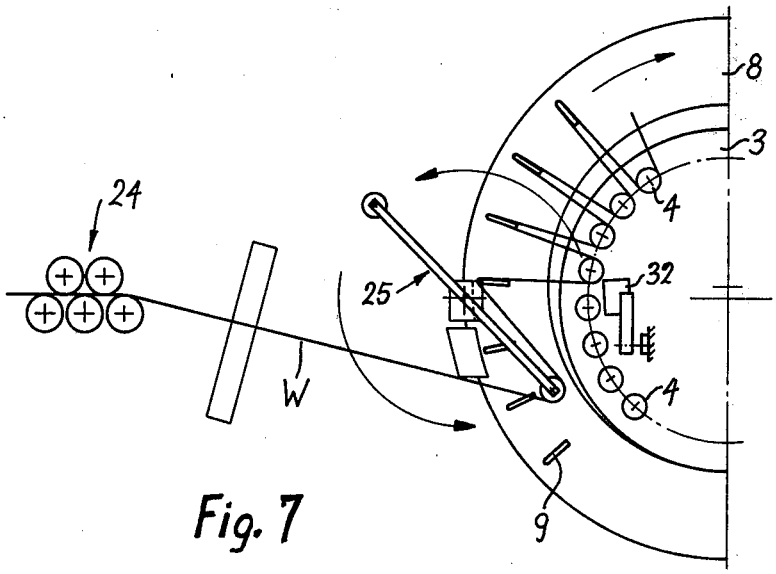

The projections 4 are shifted radially inwardly of the carrier 3 if the machine is to be converted for the making of a product with longer sections S. A few holes of a second annulus of holes for the projections 4 are shown in FIG. 6, as at 48. Alternatively or in addition to such shifting of the projections 4, the projections 9 can be moved radially outwardly or radially inwardly of the respective carrier 8 (see the slots 49 and 50 in FIG. 6).

The width of projections 4 (as considered in the circumferential direction of the carrier 3, exceeds the width of the projections 7. This results in the making of a product MB wherein the width of the prongs (each of which includes two neighboring sections S) is less than the width of the spaces between neighboring prongs. Such products are suited for the making of binders which connect the sheets of note books or the like. As mentioned above, the manner in which the product MB can be converted into discrete binders is disclosed, for example, in U.S. Pat. No. 4,020,516 to Gomez.

It is also within the purview of the invention to replace the fixedly mounted projections 9 with projections which are pivotably mounted in the respective carrier 8 so that they can be retracted into or partially expelled from the front end face **8*a* of the carrier 8. Such pivotal mounting of the pins 9 serves the same purpose as the ramp 36, i.e., to insure that an oncoming projection 9 does not interfere with the operation of the looping device 25 while the latter advances the wire W toward the foremost unoccupied inner projection 4**.

Furthermore, the pin-and-slot connections 16, 17 between the carriers 3 and 8 can be replaced by a suitable gear train which causes the outer carrier 8 to rotate the angular speed of the inner carrier 3.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. A wire forming machine, comprising first and second carriers rotatable about parallel axes; means for rotating said carriers in a predetermined direction; first and second annuli of projections respectively provided on and concentric with the respective carriers, each projection of said first annulus being adjacent to a projection of said second annulus and one of said annuli surrounding the other of said annuli so that, when said carriers rotate, the distance between the neighboring projections of said annuli increases during movement from first to second portions of the paths of orbital movement of said projections and decreases during movement from said second to said first portions; means for looping a strand of wire seriatim about successive projections of said first and second annuli during movement of projections from said first to said second portions of said paths whereby the wire is converted into a product of meandering shape and is stretched during further movement toward said second portions; and means for separating said product from said projections during movement of projections from said second toward said first portions of said paths.

2. A machine as defined in claim 1, wherein said axes are substantially horizontal.

3. A machine as defined in claim 1, wherein the width of the projections of one of said annuli, as considered in the direction of movement of said projections along the respective paths, exceeds the width of projections of the other of said annuli.

4. A machine as defined in claim 1, wherein said rotating means includes means for transmitting torque to one of said carriers and means for transmitting torque from said one carrier to the other of said carriers.

5. A machine as defined in claim 4, wherein said means for transmitting torque from said one carrier to said other carrier comprises at least one pin and slot connection including a pin attached to one of said carriers and a slot in the other carrier, said slot permitting said pin to move radially of said other carrier.

6. A machine as defined in claim 1, further comprising a source of wire and means for braking the wire intermediate said source and said looping means.

7. A machine as defined in claim 6, wherein said braking means includes a braking wheel, a torque limiter for said braking wheel, and means for intermittently rotating said wheel, the wire being trained over said braking wheel.

8. A machine as defined in claim 6, further comprising means for intermittently pulling the wire from said source intermediate said braking means and said looping means.

9. A machine as defined in claim 1, further comprising stripping means for transferring the wire from said looping means onto successive projections of one of said annuli.

10. A machine as defined in claim 9, wherein said looping means comprises a plurality of looping elements and means for orbiting said looping elements about a predetermined axis through a distance equal to that between two successive looping elements, as considered in the direction of orbital movement of said elements, while said carriers turn through an angle equal to that between two successive projections of one of said annuli.

11. A machine as defined in claim 1, wherein the distance between said parallel axes is a small fraction of one inch.

12. A machine as defined in claim 1, wherein the projections of one of said annuli have a circular cross-sectional outline and the projections of the other of said annuli are elongated, as considered in the radial direction of the respective carrier.

13. A machine as defined in claim 1, wherein the projections of one of said annuli are angularly offset with respect to the projections of the other of said annuli, as considered in the direction of orbital movement of said projections.

* * * * *